US007832344B2

(12) United States Patent
Capote et al.

(10) Patent No.: US 7,832,344 B2
(45) Date of Patent: Nov. 16, 2010

(54) METHOD AND APPARATUS OF TREATING WASTE

(75) Inventors: Jose A. Capote, Kaohsiung (CN); Joseph A. Rosin, Northbrook, IL (US); Hsien Wu, Oakland, CA (US)

(73) Assignee: PEAT International, Inc., Northbrook, IL (US)

( * ) Notice: Subject to any disclaimer, the term of this patent is extended or adjusted under 35 U.S.C. 154(b) by 695 days.

(21) Appl. No.: 11/445,445

(22) Filed: Jun. 1, 2006

(65) Prior Publication Data

US 2007/0199485 A1 Aug. 30, 2007

Related U.S. Application Data

(60) Provisional application No. 60/778,033, filed on Feb. 28, 2006.

(51) Int. Cl.
*F23G 5/10* (2006.01)
*F23G 5/12* (2006.01)

(52) U.S. Cl. ..... 110/250; 110/229; 110/346

(58) Field of Classification Search ..... 110/250, 110/345, 185, 186, 188
See application file for complete search history.

(56) References Cited

U.S. PATENT DOCUMENTS

| | | | | |
|---|---|---|---|---|
| 3,622,493 | A | 11/1971 | Crusco | |
| 3,741,134 | A | 6/1973 | Roberts et al. | |
| 3,779,182 | A | 12/1973 | Camacho | |
| 3,841,239 | A | 10/1974 | Nakamura | |
| 3,875,357 | A * | 4/1975 | Foster et al. | 110/346 |
| 4,181,504 | A | 1/1980 | Camacho | |
| 4,326,842 | A * | 4/1982 | Adachi et al. | 425/10 |
| 4,361,441 | A | 11/1982 | Tylko | |
| 4,438,706 | A | 3/1984 | Boday et al. | |
| 4,479,443 | A | 10/1984 | Faldt et al. | |
| 4,508,040 | A | 4/1985 | Santén et al. | |
| 4,615,285 | A | 10/1986 | Bentell | |
| 4,635,573 | A | 1/1987 | Santén | |
| 4,644,877 | A | 2/1987 | Barton | |

(Continued)

FOREIGN PATENT DOCUMENTS

| | | | |
|---|---|---|---|
| CN | 2527371 | Y | 12/2002 |

(Continued)

OTHER PUBLICATIONS

Spectrometric Identification of Organic Compounds, R. M. Silverstein, G. Clayton Bassler, Terence C. Morrill, John Wiley & Sons, Inc. (1991), 5th Edition (pp. 5).

(Continued)

*Primary Examiner*—Kenneth B Rinehart
*Assistant Examiner*—David J Laux
(74) *Attorney, Agent, or Firm*—Brinks Hofer Gilson & Lione

(57) ABSTRACT

A waste treatment system processes waste upon the application of energy. The system includes a vessel, and a plurality of plasma torches. Organic and/or inorganic waste may be introduced into the vessel, and the plasma torches may supply energy to treat the waste. The vessel is shaped to facilitate a cyclonic or substantially cyclonic flow of the contents within the vessel. The plasma torches may be positioned to enhance the cyclonic flow within the vessel.

17 Claims, 4 Drawing Sheets

U.S. PATENT DOCUMENTS

| | | | | | |
|---|---|---|---|---|---|
| 4,770,109 | A | | 9/1988 | Schlienger | |
| 4,831,944 | A | * | 5/1989 | Durand et al. | 110/346 |
| 4,886,001 | A | | 12/1989 | Chang et al. | |
| 4,896,614 | A | | 1/1990 | Kulkarni | |
| 4,980,092 | A | * | 12/1990 | Pineau et al. | 110/346 |
| 4,989,522 | A | | 2/1991 | Cline et al. | |
| 4,998,486 | A | | 3/1991 | Dighe et al. | |
| 5,010,829 | A | | 4/1991 | Kulkarni | |
| 5,065,680 | A | | 11/1991 | Cheetham | |
| 5,090,340 | A | | 2/1992 | Burgess | |
| 5,095,828 | A | | 3/1992 | Holden et al. | |
| 5,108,718 | A | | 4/1992 | Dummersdorf | |
| 5,127,347 | A | | 7/1992 | Cheetham | |
| 5,134,946 | A | | 8/1992 | Poovey | |
| 5,143,000 | A | | 9/1992 | Camacho | |
| 5,206,879 | A | * | 4/1993 | Moody et al. | 110/250 |
| 5,222,448 | A | | 6/1993 | Morgenthaler et al. | |
| 5,280,757 | A | | 1/1994 | Carter et al. | |
| 5,319,176 | A | | 6/1994 | Alvi et al. | |
| 5,363,781 | A | * | 11/1994 | Chang et al. | 110/250 |
| 5,399,833 | A | | 3/1995 | Camacho | |
| 5,451,738 | A | | 9/1995 | Alvi et al. | |
| 5,497,710 | A | | 3/1996 | Camacho | |
| 5,534,659 | A | * | 7/1996 | Springer et al. | 110/346 |
| 5,541,386 | A | | 7/1996 | Alvi et al. | |
| 5,544,597 | A | | 8/1996 | Camacho | |
| 5,606,925 | A | | 3/1997 | Boen et al. | |
| 5,634,414 | A | | 6/1997 | Camacho | |
| 5,657,706 | A | | 8/1997 | Liagre et al. | |
| 5,666,891 | A | | 9/1997 | Titus et al. | |
| 5,675,056 | A | | 10/1997 | Vance | |
| 5,756,957 | A | | 5/1998 | Titus et al. | |
| 5,762,009 | A | | 6/1998 | Garrison et al. | |
| 5,798,497 | A | | 8/1998 | Titus et al. | |
| 5,801,489 | A | | 9/1998 | Chism et al. | |
| 5,809,911 | A | | 9/1998 | Feizollahi et al. | |
| 5,811,752 | A | | 9/1998 | Titus et al. | |
| 5,908,564 | A | | 6/1999 | Titus et al. | |
| 5,943,970 | A | | 8/1999 | Gonopolsky et al. | |
| 5,958,264 | A | | 9/1999 | Tsantrizos et al. | |
| 6,018,471 | A | | 1/2000 | Titus et al. | |
| 6,021,723 | A | * | 2/2000 | Vallomy | 110/345 |
| 6,037,560 | A | | 3/2000 | Titus et al. | |
| 6,089,169 | A | | 7/2000 | Comiskey | |
| 6,153,158 | A | | 11/2000 | Flannery et al. | |
| 6,153,852 | A | * | 11/2000 | Blutke et al. | 110/346 |
| 6,155,182 | A | | 12/2000 | Tsangaris et al. | |
| 6,173,002 | B1 | | 1/2001 | Robert | |
| 6,182,585 | B1 | | 2/2001 | Gonopolsky et al. | |
| 6,215,678 | B1 | | 4/2001 | Titus et al. | |
| 6,222,153 | B1 | | 4/2001 | Wald | |
| 6,250,236 | B1 | | 6/2001 | Feizollahi | |
| 6,355,904 | B1 | | 3/2002 | Batdorf et al. | |
| 6,380,507 | B1 | | 4/2002 | Childs | |
| 6,388,226 | B1 | | 5/2002 | Smith et al. | |
| 6,514,469 | B1 | | 2/2003 | Kado et al. | |
| 6,551,563 | B1 | | 4/2003 | Kado et al. | |
| 6,576,807 | B1 | | 6/2003 | Brunelot et al. | |
| 6,630,113 | B1 | | 10/2003 | Surma | |
| 6,645,438 | B1 | | 11/2003 | Dubrovsky | |
| 6,763,772 | B2 | | 7/2004 | Gnedenko et al. | |
| 6,781,087 | B1 | | 8/2004 | Chism et al. | |
| 6,810,821 | B2 | * | 11/2004 | Chan | 110/250 |
| 6,817,388 | B2 | | 11/2004 | Tsangaris et al. | |
| 6,971,323 | B2 | | 12/2005 | Capote et al. | |
| 7,216,593 | B2 | * | 5/2007 | Capote et al. | 110/250 |
| 2002/0192030 | A1 | | 12/2002 | Almeida | |
| 2003/0048828 | A1 | | 3/2003 | Titus | |
| 2003/0167983 | A1 | | 9/2003 | Gnedenko et al. | |
| 2004/0159366 | A1 | | 8/2004 | Tsangaris et al. | |
| 2004/0170210 | A1 | | 9/2004 | Do et al. | |
| 2005/0204969 | A1 | | 9/2005 | Capote et al. | |
| 2007/0284343 | A1 | | 12/2007 | Choi | |

FOREIGN PATENT DOCUMENTS

| | | | |
|---|---|---|---|
| CN | 1425873 (A) | | 6/2003 |
| CN | 2663526 (Y) | | 12/2004 |
| CN | 1603686 | | 4/2005 |
| CN | 1683828 | A | 10/2005 |
| CN | 200945492 | Y | 9/2007 |
| CN | 101088581 (A) | | 12/2007 |
| CN | 101457934 | A | 6/2009 |
| EP | 0330872 | | 9/1989 |
| EP | 0 469 737 | A2 | 2/1992 |
| JP | 2003-343821 | A | 12/2003 |
| TW | 206575 | | 5/1993 |
| TW | 320258 | | 11/1997 |
| WO | WO 01/53434 | A | 7/2001 |
| WO | WO 01/79774 | A | 10/2001 |
| WO | WO 01/92784 | A1 | 12/2001 |
| WO | WO 03/069227 | A1 | 8/2003 |

OTHER PUBLICATIONS

International Search Report for PCT Application No. PCT/2005/007904, Jun. 2005.

International Search Report for PCT Application No. PCT/US2004/031310, Feb. 2005.

Rutberg, "Plasma pyrolysis of toxic waste", Plasma Phys. Control. Fusion, vol. 45, pp. 957-969, May 2003.

Scope of Supply, Terms and Conditions, and Notice to Proceed regarding NCKU PTDR System, Sep. 2002.

Rutberg et al., "The Technology and Execution of Plasmachemical Disinfection of Hazardous Medical Waste", IEEE Transactions on Plasma Science, vol. 30, No. 4, pp. 1445-1448, Aug. 2002.

Rutberg, "Some plasma environmental technologies developed in Russia", Plasma Sources Sci. Technol., vol. 11, pp. A159-A165, Aug. 2002.

Fauchais et al., "Thermal Plasmas", IEEE Transactions on Plasma Science, vol. 25, No. 6, pp. 1258-1280, Dec. 1997.

Municipal Solid Waste Feasibility of Gasification with Plasma ARC, Environmental Analyses, presented to EPRI Symposium Industrial Applications of Plasma, Palo Alto, CA, Mar. 1990.

Reference regarding PLASCON™ system.

* cited by examiner

METHOD AND APPARATUS OF TREATING WASTE

PRIORITY CLAIM

This application claims the benefit of priority from U.S. Provisional Patent Application Ser. No. 60/778,033, filed Feb. 28, 2006, which is incorporated by reference.

BACKGROUND OF THE INVENTION

1. Field of the Invention

This disclosure relates to the treatment of waste material and, more particularly, to the controlled thermal destruction of hazardous and non-hazardous materials.

2. Background

This invention relates to the treatment of waste material and, more particularly, to the controlled thermal destruction and conversion into usable products of hazardous and non-hazardous materials.

Waste material may be in a solid or liquid form and may include organic and/or inorganic material. Some solid waste materials have been disposed in landfills. However, public opposition and regulatory pressures may restrict some landfill practice.

Other solid waste and some liquid waste materials have been disposed of through combustion and/or incineration. These processes may produce substantial amounts of fly ash (a toxic constituent) and/or bottom ash, both of which by-products require further treatment. Additionally, some combustion and/or incineration systems suffer from the inability to maintain sufficiently high temperatures throughout the waste treatment process. In some systems, the reduced temperature may result from the heterogeneity of the waste materials. In other systems, the reduced temperature may result from the varying amount of combustible material within an incinerator. As a result of the lower temperatures, these incineration systems may generate hazardous materials which may be released into the atmosphere.

SUMMARY

A waste treatment system processes waste upon the application of energy. The system includes a vessel, and a plurality of plasma torches. Organic and/or inorganic waste may be introduced into the vessel, and the plasma torches may supply energy to treat the waste. The vessel is shaped to facilitate a cyclonic or substantially cyclonic flow of the contents within the vessel. The plasma torches may be positioned to enhance the cyclonic or substantially cyclonic flow within the vessel.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

A waste treatment system processes waste through the application of energy. The system may receive and treat inorganic and/or organic solid waste and/or liquid waste. The system may facilitate a turbulent/cyclonic or substantially turbulent/cyclonic flow of the contents within the vessel. Particles of organic waste may be gasified and retained in a plasma energy field and/or a turbulent zone of the vessel to promote the gaseous dissociation of the liquid waste.

Figure 1:
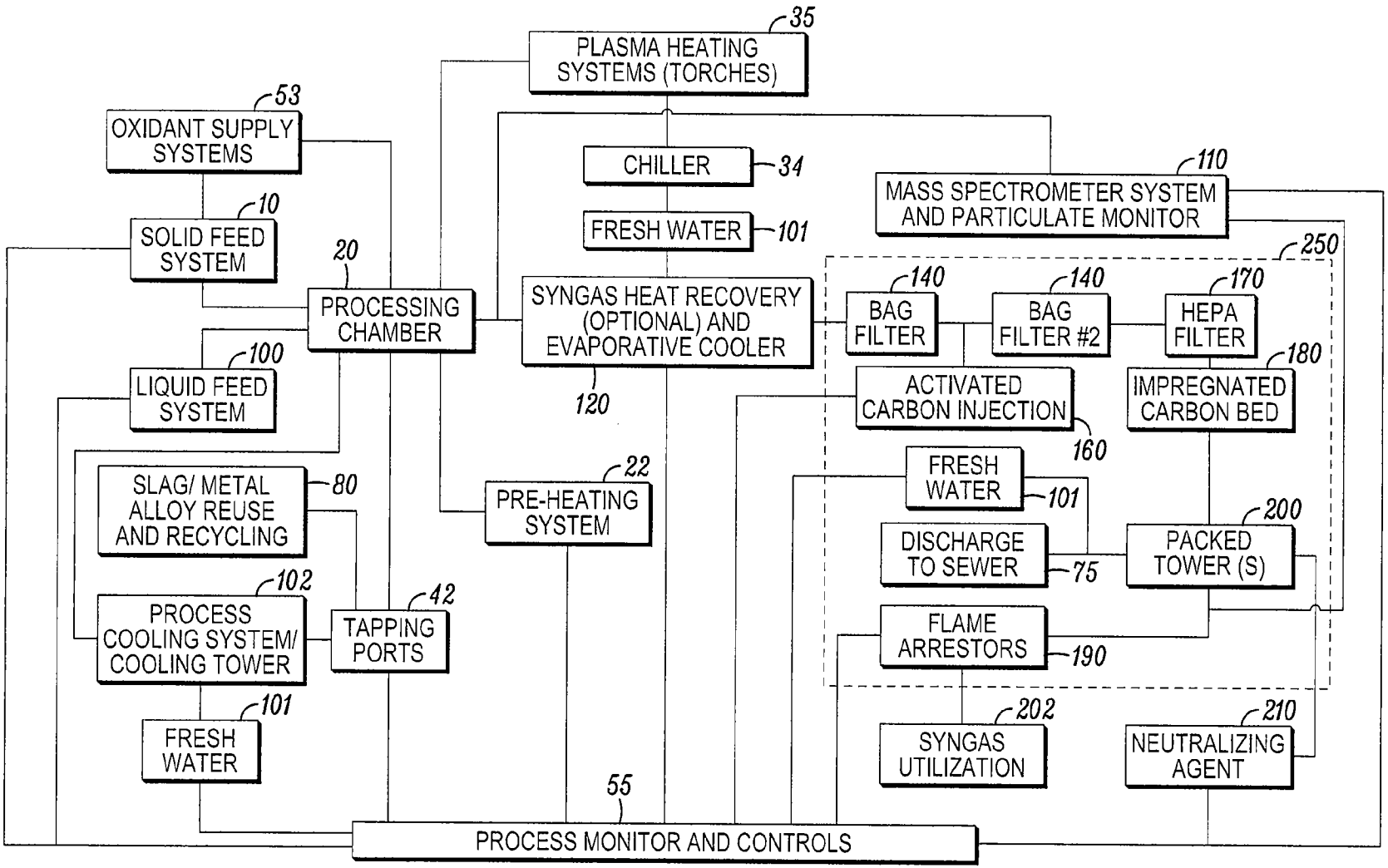
FIG. 1 is a block diagram of a waste treatment system.

FIG. 1 is a block diagram of a waste treatment system 5. Waste treatment system 5 may treat inorganic and/or organic solid waste and/or liquid waste. Waste treatment system 5 may include processing chamber or vessel 20 coupled to a solid waste feed system 10, such as the solid feed system disclosed in U.S. Pat. No. 5,534,659, which is incorporated by reference herein, and/or a solvent waste feed system 100, such as the solvent feed system disclosed in U.S. patent application Ser. No. 10/673,078, filed Sep. 27, 2003, now U.S. Published Application No. 2005/0070751, published Mar. 31, 2005, which is incorporated by reference herein. Solid waste feed system 10 and/or solvent waste feed system 100 may provide to vessel 20 inorganic and/or organic waste material, such as municipal solid waste, Polychlorinated Biphenyls ("PCB") contaminated materials, refinery waste, office waste, cafeteria waste, facilities maintenance waste (e.g., wooden pallets, oil, grease, discarded light fixtures, yard waste, wastewater sludge), pharmaceutical waste, medical waste, fly and bottom ash, industrial and laboratory solvents, organic and inorganic chemicals, pesticides, organochlorides, thermal batteries, post-consumer batteries, and military waste, including weapon components. Some of these waste materials may be provided to vessel 20 through a gravity feeding chute which may be included with solid waste feed system 10.

Solid and liquid waste may be treated separately or at substantially the same time. To process the waste separately, the solid and liquid waste is separately introduced into vessel 20. To process the waste at substantially the same time, the solid and liquid waste is introduced into vessel 20 at substantially the same time. When the solid and liquid waste is processed at substantially the same time, liquid waste may be introduced into solid waste feed system 10 to create a homogenous mix of solid and liquid waste. Alternatively, liquid waste may be introduced into vessel 20 through liquid waste system 100 at substantially the same time that solid waste is introduced into vessel 20 through solid waste system 10. Waste treatment system 5 may process equal or non-equal portions of solid and liquid waste.

The desired rate at which waste is fed into vessel 20 is dependent on various factors, such as the characteristics of the waste, the energy available from a heating system versus the energy expected to be required for the completion of a gasification and melting process, the expected amount of synthesis gas to be generated by versus the design capacity of a gas cleaning and conditioning system, and/or the temperature and/or oxygen conditions within vessel 20. The feed rate may be initially calculated based on an estimation of the energy required to process the specific waste type being treated.

Inorganic waste may be fed into vessel 20 where it may be vitrified or melted, by a plasma heating system 35. Plasma heating system 35 may include alternating current and/or direct current plasma torches that may input energy into vessel 20. A chilling system may be used to control the temperature of cooling water supplied to the plasma torches to keep the torches' metal enclosures at acceptable temperatures. The vitrified or melted waste may form a slag (e.g., molten material), such as a glass-like slag, which may collect in a slag pool 103 at the bottom of vessel 20. In some instances, a separable metal layer may form in slag pool 103. The slag may be drained from vessel 20, through one or more tapping ports 42 which may be positioned at an appropriately designated elevation from the bottom of the vessel and may be located at opposite radial locations around the circumference of the vessel. One or more of tapping ports 42 may be positioned at an angle such that the molten slag layer may maintain a continuous gas seal. The angle of the one or more tapping ports 42 may be about 10 degrees with respect to a horizontal plane intersecting vessel 20 at the location of a tapping port.

Slag may be removed/drained from slag pool 103 into a slag/metal alloy reuse and recycling system 80, such as a sealed water tank, through tapping ports 42. The sealed water tank may include water which may be regenerated at a substantially continuous rate. The drained slag may be rapidly quenched (and solidified), in the water tank, causing the solidified material to fracture into smaller pieces. The solid slag can be essentially inert because heavy metals may be bound within it. Consequently, the slag can resist leaching in the solid state. The solid slag may then be transported from slag/metal alloy reuse and recycling system 80 to a bin by a conveyor or other suitable device for transport and disposal.

The slag may also be drained though tapping ports 42 into water-cooled tap carts 156 which may be removed from vessel 20 after the slag is cooled and has solidified. As a further alternative, the slag may be drained into other specially designed components, such as molds insulated by sand. In some systems, tapping ports 42 may include one or more than one tap. Where there is more than one tap, taps may be positioned at different locations of vessel 20 and/or at different heights. Taps may be opened one at a time, in an alternating sequence, or at substantially the same time. During tapping, feeding and/or treatment of waste in vessel 20 may continue.

The solid slag, which may be benign and does not require landfilling, may be used for a number of commercial applications, such as road construction, concrete aggregate, blast cleaning, fiberglass, and/or fiberglass-like material. It may also be formed into decorative tiles, or used in conjunction with building materials to create lightweight pre-engineered home construction materials. During non-tapping operations, tapping ports 42 may be closed by water cooled tap plugs. Cooling water may be supplied by process cooling system 102 which may draw water from fresh water supply 101.

As a result of the low oxygen, reducing, environment in the vessel, some meta-oxides present in the waste streams may be reduced into their elemental form. Metals and metal alloys present in the waste feed may also melt in vessel 20. Over a period of time, a layer of metals may accumulate at the bottom of slag pool 103. Certain metals such as iron may not react readily with silicates contained in slag pool 103. The slag may absorb some of these metals, but the metals may accumulate if a large amount of metal is present in the waste. The molten metals may be drained, along with the molten slag, through tapping ports 42, and processed as described above.

Organic waste received in vessel 20 may undergo a pyrolysis process. Pyrolysis is a process by which intense heat operating in an extremely low oxygen, reducing, environment dissociates molecules, as contrasted with incineration or burning. During this process, the organic waste may be heated by a heating system, such as one or more plasma torches and/or plasma torch flames. The heated organic waste may be gasified until it dissociates into its elemental components, such as solid carbon (carbon particulate) and hydrogen gas. Oxygen, nitrogen, and halogens (such as chlorine) may also be liberated if present in the waste in the form of a hydrocarbon derivative. After pyrolysis and/or partial oxidation, a resulting gas (e.g., synthesis gas) may include carbon monoxide, hydrogen, carbon dioxide, water vapor, methane, and/or nitrogen.

Dissociated oxygen, and chlorine may be free to react with the carbon and hydrogen produced, and may reform as a wide array of complex and potentially hazardous organic compounds. Such compounds, however, generally cannot form at the high temperatures maintained within vessel 20, at which only a limited number of simple compounds may be stable. The most common and stable of these simple compounds are carbon monoxide (formed from a reaction between the free oxygen and carbon particulate), diatomic nitrogen, hydrogen gas, and hydrogen chloride gas (when chlorine is present).

The amount of oxygen present in the waste material may be insufficient to convert all of the carbon present in the waste material into carbon monoxide gas. Moisture present in the waste material will absorb energy from the high temperature environment in vessel 20 through a "steam-shift" reaction and form carbon monoxide and hydrogen gas. If an insufficient amount of oxygen or moisture, such as below 30% by weight, is present in the waste stream and/or as a result of inherent process inefficiencies, unreacted carbon particulates may be entrained in the gas stream and carried out of the high temperature reaction zone in vessel 20.

To increase the amount of solid carbon converted to carbon monoxide gas, an additional source of oxygen may be introduced into vessel 20. Waste processing system 5 may include a means for injecting an oxidant, supplying the additional oxygen, into the system in an amount that facilitates some or a substantial portion of the carbon particulate to carbon monoxide. The injection means may be an oxidant supply system 53 which may include oxygen lances 44 to inject additional oxygen into vessel 20. The oxygen lances may injection about 90% or more oxygen into vessel 20. Predetermined amounts of the oxidant may be injected into vessel 20 at one or more locations. Alternatively, different oxidants such as air or steam may be used alone or in combination with other methods. In some systems, the oxidant may be introduced into vessel 20 through other means, such as through plasma heating system 35, mixed with the waste within solvent feed system 100, or through a steam generator and steam valve, opened in a controlled manner, which may be coupled to an upper portion of vessel 20 and/or a gas pipe.

The oxidant injected into the system may convert some or a substantial portion of the free carbon into carbon monoxide. Because pure carbon is more reactive at the high operating temperatures than the carbon monoxide gas, the additional oxygen may react with the carbon and form carbon monoxide, and not with the carbon monoxide to form carbon dioxide (assuming that the oxidant is not added in excess).

The carbon and oxidant may remain in vessel 20 for a period of time such that a substantial portion of the previously unconverted solid carbon may be converted to carbon monoxide ("residence time"). The residence time may be the amount of time that the synthesis gas and entrained particulate, and oxidant remain in a turbulent region of vessel 20 and/or a gas vent 40 (and associated piping). The residence time may be a function of the system volume and geometry, and the synthesis gas flow rate. At waste treatment system's highest synthesis gas flow rate, the volume of vessel 20, the size and configuration of turbulent region 104, and gas vent piping should provide a sufficient residence time for a substantially complete dissociation of the organic materials and the pyrolysis reactions to occur. The residence time within vessel 20 may be within a range of between about 1.75 second and about 2.00 seconds. Additional residence time may be provided by the gas vent piping, such that the total residence time of waste treatment system 5 may exceed about 2.00 seconds.

The amount of oxidant added through oxidant injection means, such as oxygen lances 44, may be closely controlled. Excess oxygen in the system may cause combustion to occur, which may lead to the formation of carbon dioxide (which has no fuel value). In addition, excess oxygen in the system may result in the presence of free oxygen molecules in the synthesis gas carried out to the gas cleaning and conditioning system. The free oxygen molecules may create potential safety considerations associated with uncontrolled combustion of the synthesis gas and, depending on other conditions, such as the right temperature range, could lead to the formation of compounds such as polyaromatic hydrocarbons, dioxins, and furans.

The amount of oxidant injected into vessel 20 may be determined through a detector system 110. Detector system 110 may include a detector such as a mass spectrometer. The mass spectrometer may monitor at a substantially continuous rate the composition of the synthesis gas generated in vessel 20. The mass spectrometer may measure the masses and relative concentrations of the atoms and molecules exiting vessel 20 through the use of magnetic forces acting on charged particles. Measured components may include CO, $CO_2$, HCl, $H_2$, $CH_4$. $N_2$, $O_2$, and/or $H_2S$. Additionally, detector system 110 may include a particulate monitor which may measure at a substantially continuous rate the broad level of particulates carried over in the synthesis gas stream exiting vessel 20. The mass spectrometer and/or the particulate monitor may sample the synthesis gas at a point prior to syngas heat recovery and evaporative cooler system 120 and/or at a point after the synthesis gas has been cleaned, such as after packed towers 200. Based on the results of the mass spectrometer and/or the particulate monitor, manual and/or automatic adjustments may be made to the feed rate, and/or composition of waste material, and/or torch power, and/or the amount of oxidant injected into the system. Alternatively, detector system 110 may sample the synthesis gas at substantially regular intervals separated by a time period. These sample periods may be statistically analyzed to determine whether manual and/or automatic adjustments to the feed rate, and/or composition of waste material, and/or torch power, and/or the amount of oxidant injected into the system are required.

The synthesis gas, generated within vessel 20, may be heated to a temperature in the range of at least about 900° C. to about 1500° C. After exiting vessel 20, the synthesis gas may be processed by syngas heat recovery and evaporative cooler system 120. Syngas heat recovery and evaporative recovery system 120 may include an evaporative cooler that uses the evaporation of a flow of water (the flow of water being dependent on the amount of throughput of feedstock) to remove the latent enthalpy of the synthesis gas. Additionally, syngas heat recovery and evaporative cooler system 120 may include a heat recovery steam generator ("HSRG") that may be used to recover the enthalpy of the synthesis gas at is leaves the vessel 20. If an HRSG is installed upstream of gas cleaning and conditioning system 250, the load on the evaporative cooler may be reduced. Thus, the evaporative cooler may be used with or without an HRSG.

Downstream of syngas heat recovery and evaporative cooler system 120, the synthesis gas may be processed by gas cleaning and conditioning system 250. Gas cleaning and conditioning system 250 may include two or more bag houses 140. Bag houses 140 may be arranged in series and may be used to remove particulates from the synthesis gas. For example, bag houses 140 may be used to collect some particulates that may be dislodged from the synthesis gas as it is blasted with compressed clean nitrogen. The particulates may include metal oxides, solid volatile metal particles, and/or unreacted carbon, and may be recovered for beneficial use in other industries and/or technologies.

Gas cleaning and conditioning system 250 may also include an activated carbon injection system 160 which may be installed between bag houses 140. Activated carbon injection system 160 may substantially remove or remove trace amounts of dioxins and furans that may have formed during the synthesis gas cooling process. Additionally, activated carbon injection system 160 may substantially remove or remove mercury and/or mercury oxide (if present). Because of its volatile nature, the mercury and/or mercury oxide is not substantially removed or removed by a bag house 140.

A High Efficient Particulate Air ("HEPA") filter 170 may receive the synthesis gas exiting from a bag house 140. HEPA filter 170 may substantially remove or remove dust particulates within the synthesis gas. More specifically, HEPA filter 170 may process heavy metal and metal oxide particles that escape recovery in a bag house 140. Waste treatment system 5 may operate with or without HEPA filter 170.

An impregnated carbon bed 180 may be positioned downstream of bag houses 140 and upstream of packed tower 200. In systems where HEPA filter 170 is not present, impregnated carbon bed 180 is installed downstream of bag houses 140, otherwise impregnated carbon bed 180 is installed downstream of HEPA filter 170. Impregnated carbon bed may remove any residual mercury (assuming that mercury containing materials were present in the waste material) from the synthesis gas that was not removed by bag houses 140. If mercury particles are present, bag houses 140 and spent carbon beds contained within activated carbon injection system 160 may require processing in a mercury recovery retort system (not shown). Mercury recovery retort system may remove and recover some or substantially all of the collected mercury for subsequent uses, such as use in thermometers, barometers, fluorescent lamps, and/or batteries. The treated mercury free synthesis gas may then be recovered for other subsequent uses. A plurality of packed towers 200, such as two, may receive the synthesis gas passing through impregnated carbon bed 180. The plurality of packed towers 200 may scrub the synthesis gas to remove acid gases present within the synthesis gas. Alternatively, the synthesis gas may be recovered using a gas cleaning and conditioning system as described in U.S. Pat. No. 6,971,323, which is incorporated by reference herein, and/or U.S. patent application Ser. No. 10/673,078.

A neutralizing agent 210, such as a solution of sodium hydroxide, described in U.S. Pat. No. 6,971,323, may be used to scrub the gas stream of acid gases. The neutralizing agent 210 may be introduced by a pump into a recirculating water stream. The recirculating water may be periodically sampled to ensure a proper pH level of between about 6 and about 9. A portion of the recirculating water flow, such as about 5 gpm, is discharged to treat the synthesis gas. The discharge may be periodically sampled to ensure that the discharge water flow meets regulatory limits. If found to meet regulatory discharge standards, some or all of the collected solution may be discharged to a wastewater treatment system 75. The discharge water may contain sodium salts.

The resulting clean fuel gas includes mostly hydrogen and carbon monoxide, and more particularly, may be about 30% to about 40% hydrogen gas and about 30% to about 35% carbon monoxide gas. The clean fuel gas may be used (e.g., syngas utilization 202) as a fuel for steam or electricity generating equipment, or the hydrogen may be extracted via Pressure Swing Adsorption ("PSA") technology and used as a source of alternative/renewable fuel source for components such as Proton Exchange Membrane ("PEM") fuel cells. Alternatively, the synthesis gas may be used as a feedstock for liquid fuels such as Fischer-Tropf Diesel, ethanol, and/or methanol.

Alternatively, if the resulting clean fuel gas will not be used productively, a thermal oxidizer system may be provided. The thermal oxidizer may combust the clean fuel gas as described in U.S. patent application Ser. No. 10/673,078. A flame arrestor 190 may prevent flame propagation to the rest of the system.

Figure 2:
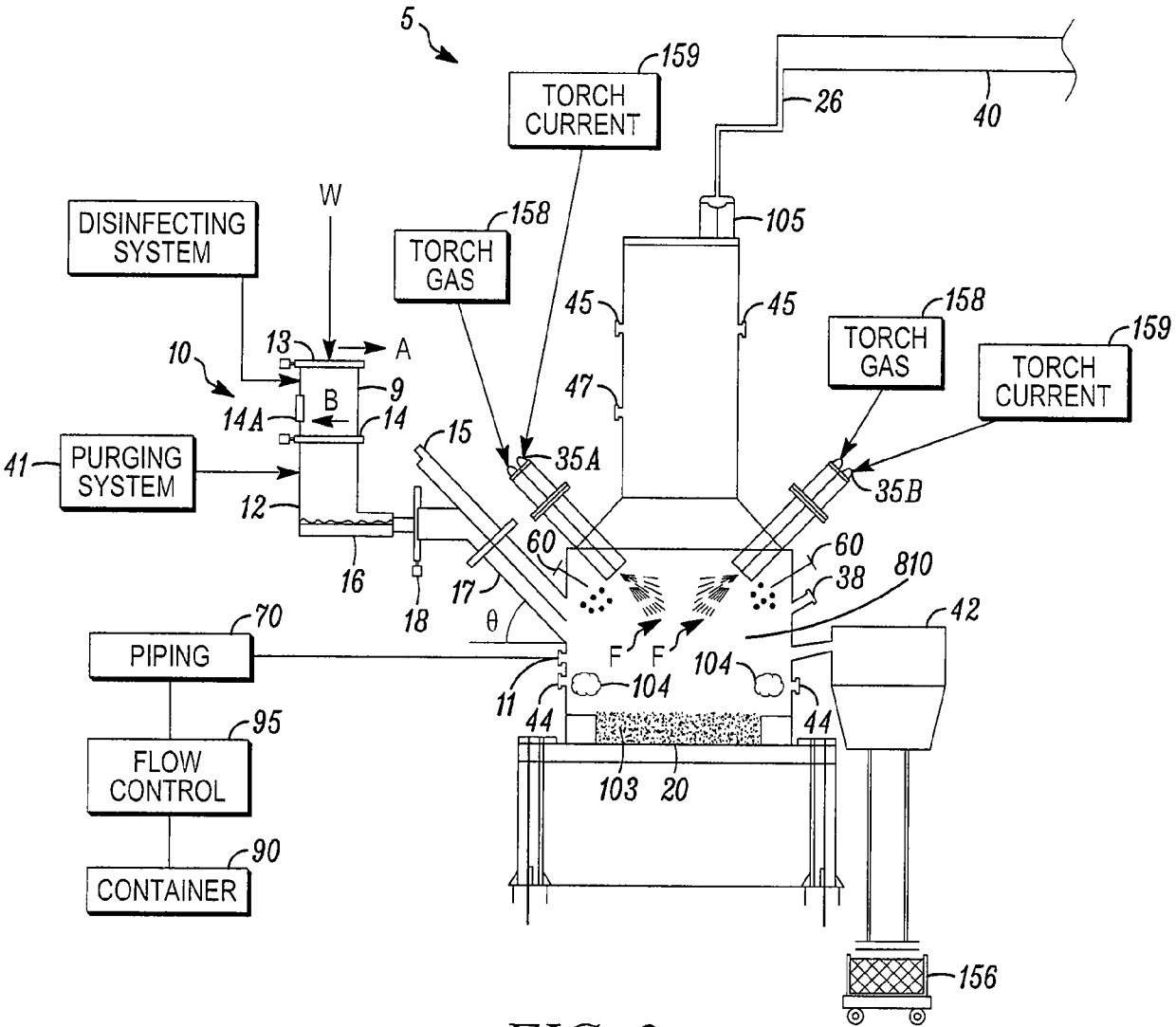
FIG. 2 is a partial schematic of a waste treatment system.

FIG. 2 is a partial schematic of a waste treatment system. In FIG. 2, solid waste feed system 10 receives waste "W" which may be fed into waste processing or pyrolysis vessel 20. The solid waste feed system 10 may include a charging hopper 9 positioned above a feed hopper 12. An airlock door 13 may function as a sliding cover for charging hopper 9. Prior to placing waste W into charging hopper 9, door 13 is moved an opened position. After the desired amount of waste W is placed into charging hopper 9, door 13 is closed in the direction of arrow "A" to cover the charging hopper 9. A second, alternately opening, sliding airlock door 14 may separate charging hopper 9 from feed hopper 12 when in a closed position. To charge feed hopper 12, door 14 is opened in the direction of arrow "B" while door 13 remains closed (to prevent the release of any emissions from feed hopper 12 into the environment and to minimize the introduction of air into feed hopper 12). Each door 13 and 14 can be provided with appropriate seals that cooperate with seals in the side walls of charging hopper 11 to substantially prevent emissions from leaking out of solid waste feed system 10.

Inorganic "powdered" type waste streams such as incinerator ash, electric furnace dust or waste water treatment plant sludges, or other types of waste, may be introduced into feed hopper 12 in an alternative manner. A third sliding airlock door 14A may be provided at the side of the feed hopper 12. The door 14A can be operated in a manner similar to the doors 13 and 14. The door 14A, furthermore, can be interlocked such that it cannot be opened when either of the slide doors 13 and 14 is open.

A purging system 41 may be provided to introduce a gas, such as nitrogen, into feed hopper 12 and/or at other points in solid waste feed system 10. The purging system 41 may include a source of nitrogen, such as a nitrogen tank, tubing interconnecting the nitrogen source and feed hopper 12, and appropriate valving to regulate the quantity of nitrogen introduced into feed hopper 12 and the timing of the purging. In addition, the purging system 41 can be selectively operated along with sliding doors 13 and 14. In this manner, the purging system can purge hazardous emissions that may become contained in solid waste feed system 10 before or while doors 13 and 14 are opened. The purging system 41 can also limit the amount of combustible gases generated in vessel 20 from escaping from vessel 20 or feed hopper 12. The nitrogen gas may be vented to vessel 20.

The interior of feed hopper 12 may be relatively open and free of obstructions and contain minimal crevices or cracks in which infectious material can accumulate. This design can help allow feed hopper 12 and a cantilevered screw-type auger 16 to be disinfected by a disinfectant system 50. Disinfectant system 50 may include a supply container in which an appropriate disinfectant is retained. For example, a disinfectant comprising a 6% solution of hydrogen peroxide may be used. The supply container may be connected by a supply line to an injector nozzle mounted within feed hopper 12. The disinfectant may be pressurized by a pump. The disinfectant injector nozzle may be arranged such that some or substantially all of the area within feed hopper 12 may be subjected to the disinfectant spray. This may help minimize and/or prevent the release of toxic or hazardous emissions when door 14 to feed hopper 12 is opened. Alternatively, several nozzles may be used and each nozzle may be positioned to spray disinfectant on a different portion of feed hopper 12. After the disinfectant is applied, the disinfectant may drain into the vessel 20 and be processed as waste.

After waste is placed into charging hopper 12, auger 16 may shred, mix, compress, and extrude the waste into a feed tube 17. Auger 16 may be driven by a motor, such as a hydraulic motor with a variable speed drive, and may be a hydraulic-powered screw conveyor feeder, manufactured by Komar Industries. Feed tube 17 may be surrounded by a water-cooled jacket to help keep feed tube 17 cool and to help maintain the structural integrity of feed tube 17, which may be exposed to the elevated temperatures in vessel 20. The water-cooled jacket may be connected to a water source with a pump. The water can be circulated by the pump in two directions, from the side of the water-cooled jacket closest to vessel 20 to the opposite side, and from the side of the water-cooled jacket closest to the feed hopper 12 to the opposite side. In the alternative, water can be circulated in both directions. Also, the water may be circulated in two loops, where one loop circulates water to the portion of the water-cooled jacket closest to the vessel 20, and the other loop circulates water to the portion of the water-cooled jacket closest to the feed hopper 12.

A feed tube slide gate 18 (which also may be water cooled) may be provided to isolate feed hopper 12 from vessel 20. Feed tube slide gate 18 may be provided near the outlet of feed hopper 12 or positioned some distance from the outlet of feed hopper 12 along feed tube 17. The opening and closing of feed tube slide gate 18 may be automatically controlled and can be interlocked such that feed tube slide gate 18 cannot be opened when either of slide doors 13 and 14 is open.

Feed tube 17 may be sloped toward the opening of vessel 20 at an angle such that gravity may facilitate the flow of liquids and/or solid matter into vessel 20. Feed tube 17 may be at an angle θ of about 15 degrees. Additionally, feed tube 17 may include a feeding chute 15 which may allow for feeding, either automatically or manually, waste that cannot be shredded or waste that is too wet to be placed within feed hopper 12. Waste that cannot be shredded may include batteries, such as lithium-ion batteries or wastes encased in canisters, such as reactive materials. Gravity may assist the introduction of this waste into vessel 20. Feed chute 15 may include isolation gates, a purging system, and/or disinfection nozzles.

A solvent waste feed system 100 may introduce solvent waste into vessel 20 through nozzles 60. In FIG. 2, only two nozzles 60 are shown, however it is to be understood that any number of nozzles may be used for introducing solvent waste into the vessel 20. For example, only one nozzle may be used or ten nozzles, equally or non-equally spaced apart, may be used. Solvent waste feed system 100 may use enough nozzles to accommodate the desired rate at which the solvent is collectively fed into the vessel.

Waste may be fed through nozzles 60 from the same or a separate waste source in an alternating manner, a sequential manner, or at substantially the same time through all nozzles. In addition, the solvent waste fed through each nozzle may be different. For example, the solvent waste from one manufacturing process may be introduced through one nozzle and solvent waste with a different constituency from a different manufacturing process may be introduced through another nozzle (simultaneously or in an alternating manner). The number of nozzles used and the manner in which they are employed will depend on the particular application.

Nozzles 60 may be positioned to introduce, such as through the use of a pump, solvent waste into the plasma torch plumes and/or the paths of the plasma torch plumes. In other implementations, the solvent waste may be introduced into other areas in relation to the plasma torch plumes, such as into turbulent region 104. Nozzles 60 may be positioned in open area 810 of vessel 20 that are surrounded by refractory materials. This positioning can facilitate the transfer of energy from the plasma plumes to the solvent waste.

Alternatively, nozzles 60 may be configured to maximize the surface area of the solvent waste by generating atomized micro-droplets. By maximizing the surface area of the droplets, energy from the plasma plumes may be transferred to the droplets at a greater rate. This can be accomplished by mixing compressed air with the solvent waste in the nozzles. An exemplary atomizing nozzle is the Flomax FM1 nozzle manufactured by Spraying Systems Co., located in Wheaton, Ill. An exemplary rate for introducing the compressed air into the nozzle is about 235 kg/hour to about 250 kg/hour.

Solvent waste feed system 100 may include a container 90 that houses the solvent waste and piping 70 connecting container 90 and nozzles 60. Piping 70 may be constructed of stainless steel ("SS") seamless pipe (for example, SS 304 and/or SS 316). In addition, solvent feeding system 100 may include a flow control system 95, such as a PLC-based flow control system with a pump, connected with piping 70 that is capable of automatic and remote manual set points to high levels of precision. An exemplary pump is the Multi-Stage Centrifugal pump made by Goulds Pumps (back pressure control valves may also be used). It should be understood, however, that the particular solvent waste feed system 100 employed is generally application specific. It should also be understood that any type of known means, or any means subsequently developed, for feeding or transferring solvent waste to nozzles 60 may be employed with the waste processing apparatus described herein. For example, solvent waste may be transferred to nozzles 60 through a single pipe or through multiple pipes that feed into a single pipe. Conversely, the solvent waste may be transferred through a single pipe that feeds into multiple pipes where each of the multiple pipes feeds a separate nozzle.

The rate at which the solvent waste is fed into vessel 20 through nozzles 60 may be initially calculated based on an estimation of the energy required to process the specific waste type being treated. The desired feed rate may be determined by actual operation of the system, and may be selected to maintain a desired average temperature within vessel 20. Plasma torches 35A and 35B may input energy into vessel 20 and the injected solvent waste may absorb the energy as it is fed into vessel 20. An excessive feed rate maintained for a period of time can cause the interior temperature of vessel 20 to decrease. Conversely, an inadequate feed rate can cause vessel 20 to overheat. Accordingly, the desired feed rate is selected to achieve the desired average temperature, which may be in the range of about 1400° C. to 1500° C.

Vessel 20 may be vertically oriented, and may be constructed in parts or sections, such that if any part is removed for maintenance the other parts may remain in place. Vessel 20 may include a lower generally cylindrical reaction chamber 21, and an upper generally cylindrical reaction chamber 22. A generally frustoconical section 23 may be positioned between lower reaction chamber 21 and upper reaction chamber 22. Lower reaction chamber 21 may include a molten slag/metal section and a high temperature/turbulent section (to promote gaseous dissociation and pyrolysis reactions). Additionally, vessel 20 may include a manhole for entry into vessel 20 during a shutdown/maintenance period. The dimensions of the manhole may be approximately 500 mm by approximately 500 mm.

Vessel 20 may be lined with a combination of refractory material which may be arranged in several layers. Factors that may be considered in selecting the appropriate refractory material may include vessel's 20 shell strength, vessel's 20 heat loss, and or erosion factors. The refractory materials may be selected such that an outside vessel wall temperature may be in the range of about 120° C. to about 130° C. An innermost refractory layer may provide resistance to corrosion, a second layer may provide low thermal conductivity and high insulating qualities, and a third layer may include insulating board. The lower portion of lower reaction chamber 21 may include Silicon-Carbide refractory bricks which may withstand the potentially highly corrosive environment created by the slag. To offset the effects of erosion in long term operation, this portion of lower reaction chamber 21 may be designed with extra thickness.

The generally frustoconical section 23 of vessel 20 may include one or more inspection ports 38 which may provide visibility to the interior of vessel 20, the waste "W", plasma plumes, and/or slag pool 103. The generally frustoconical section 23 of vessel 20 may also provide a support mechanism for a plurality of plasma torches. Plasma heating system 35 may include plasma torches 35A and 35B (and/or 35C, shown in FIG. 3). In systems using DC plasma torches, a section of each of the plurality of plasma torches 35A, 35B, and/or 35C may penetrate through an opening in the refractory material and into vessel 20. Each plasma torch 35A, 35B, and/or 35C may emit a plasma flame, "F" (e.g., plasma plume or plasma energy field) with temperatures ranging between about 6000° C. to about 10000° C. Plasma torches 35A, 35B, and/or 35C may heat the interior of vessel 20 to a temperature between about 1400° C. and about 1500° C. Alternatively, in systems using AC plasma torches, the torch body is positioned and supported outside of vessel 20. In these systems, vessel 20 may be designed such that the plasma flame penetrates into vessel 20. Plasma torches 35A, 35B, and/or 35C may be AC plasma torches such as the AC plasma torch manufactured by The Institute for Problems of Electrophysics—Russian Academy of Sciences (IPE-RAS), located in St. Petersburg, Russia; DC plasma torches, such as the 350 KW DC plasma torch manufactured by Advance Plasma Technology Inc., located in Korea; or a combination of AC and DC torches. Plasma torches 35A, 35B, and/or 35C may receive torch gas 158 and torch current 159.

Plasma torches 35A, 35B, and/or 35C may be oriented to enhance a cyclonic or substantially cyclonic flow of the contents with vessel 20. The orientation of plasma torches 35A, 35B, and 35C may maximize the amount of time the synthesis gas and/or entrained particulate remain in the high temperature section of lower reaction chamber and/or gas vent 40 ("residence time"). The residence time may be a function of the system volume and geometry, and the gas flow rate. At the highest gas flow rate, the volume of vessel 20, turbulent region 104, and gas flow vent 40 should provide a sufficient resident time for dissociation of organic material to occur. Additionally, the orientation of plasma torches 35A, 35B, and 35C may minimize the carry over of particulates within the synthesis gas.

Figure 3:
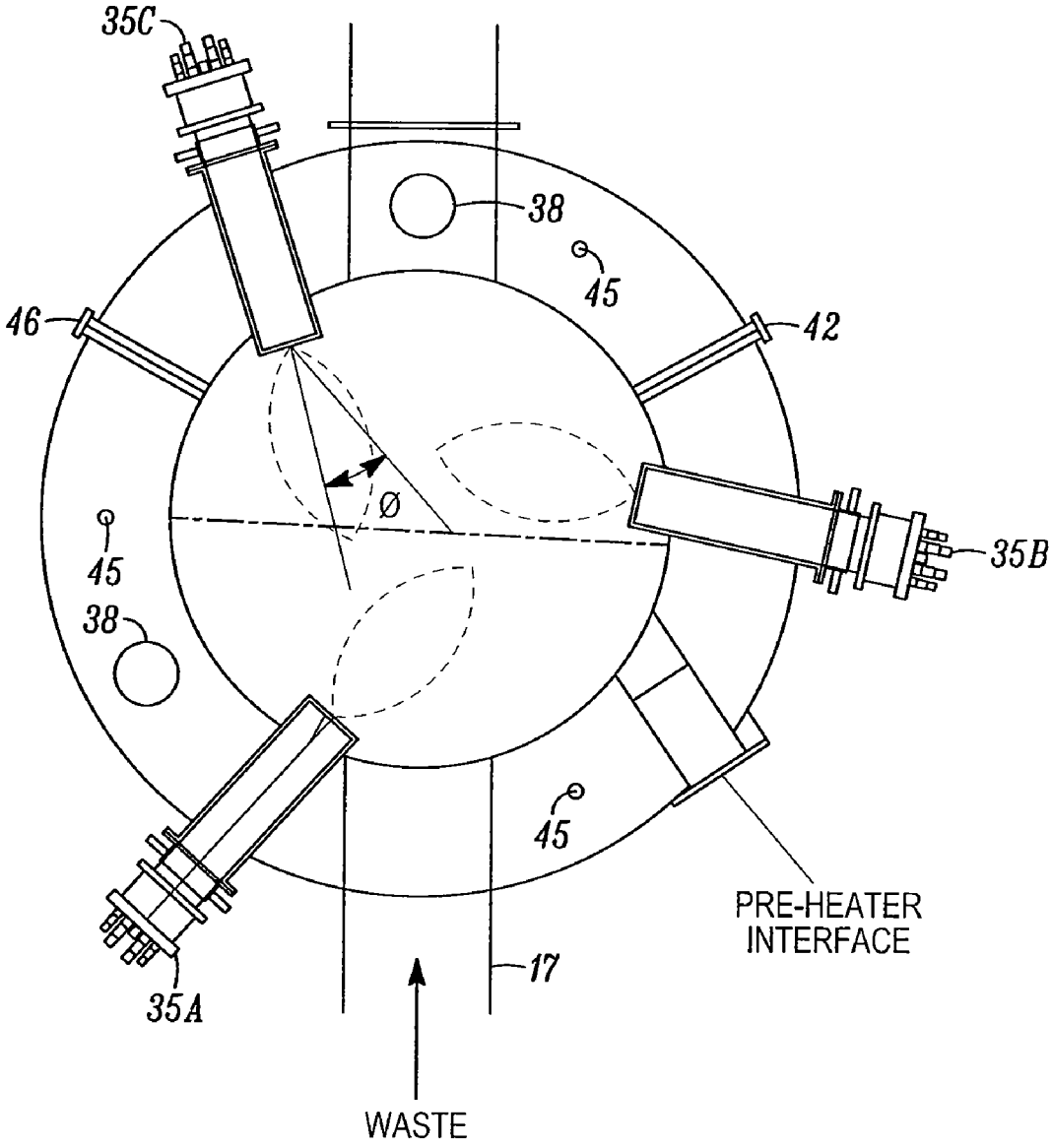
FIG. 3 is a partial top plan view of the vessel of FIG. 2.

An exemplary orientation of plasma torches 35A, 35B, and 35C, may include orienting the torches at an angle. One or more of the plurality of plasma torches may be oriented at a downward angle of about 45 degrees from the vertical. Additionally, one or more of the plurality of plasma torches may be oriented at a lateral angle. FIG. 3 is a partial top plan view of vessel 20 of FIG. 2. In FIG. 3 each of the plurality of plasma torches is at a lateral angle. In FIG. 3, an imaginary center line extending from the center of a plasma torch may be at an angle $\phi$ of about 17 degrees with respect to an imaginary radial line extending from the center of vessel 20 and intersecting the imaginary center line extending from the plasma torch at the interior surface of vessel 20 (e.g., a bias angle). Each of the plurality of plasma torches may be at a similar or different bias angle. Moreover, other bias angles may be contemplated. Plasma torches 35A, 35B, and/or 35C may be positioned such that the elongated portion of a plasma flame (e.g., plumes) of one or more of the torches may be directed toward a particular target.

In some systems, plasma torches 35 may be directed toward one or both of the feed systems, such as directing one plasma torch toward the solid feed while directing the other two torches toward slag tapping ports to maintain a substantially molten state. Alternatively, in some systems, one torch may be directed toward the solid feed, one torch may be positioned above a solvent feed system nozzle such that the spray from the nozzle is directed toward the plasma plume, and one torch may be directed toward a slag tapping port. Other configurations as to the orientation of plasma torches 35 with respect to the feed system inputs and/or tapping ports may be used. Although three torches are shown in FIG. 3, waste treatment system may include more or less torches.

As the temperature within vessel increases, the contents, such as air; waste; and/or particulates, within vessel 20 may undergo movement as a result of general physics principals. As the contents within vessel 20 moves, the contents may encounter boundaries resulting from the shape of the generally frustoconical section 23 of vessel 20. The generally frustoconical shape may facilitate a turbulent/cyclonic or substantially turbulent/cyclonic flow of the contents within vessel 20. The positioning of one or more of the plurality of plasma torches may enhance the turbulent/cyclonic or substantially turbulent/cyclonic flow within vessel 20. The turbulent/cyclonic or substantially turbulent/cyclonic flow within vessel 20 may increase the amount of time (e.g., residence time) that the synthesis gas and some or substantially all of the entrained particulate may remain within turbulent region 104. Additionally, the turbulent/cyclonic or substantially turbulent/cyclonic flow may facilitate the movement of the synthesis gas and some or substantially all of the particulate into the upper reaction chamber 22.

Upper reaction chamber 22 may include one or more injection ports 45 and 47. Injection ports 45 and 47 may be located around the perimeter of upper reaction chamber 22. Upper ports 45 may inject steam into upper reaction chamber 22 while lower ports 47 may inject oxygen into upper reaction chamber 22. The injected steam and/or oxygen may react with carbon particles and/or volatile metals that have escaped lower reaction chamber 21 such that CO, $H_2$, and/or metal oxides may be formed. Additionally, the injected steam may reduce the temperature of the synthesis gas prior to entering the gas conditioning and cleaning system 250. Prior to entering the gas conditioning and cleaning system 250, the synthesis gas may be cooled to a temperature of about 1000° C.

In an exemplary configuration, vessel 20 may have a total volume of about 4.5 $m^3$. The total height of vessel 20 may be about 2.97 m, with lower reaction chamber 21 having a radius of about 0.85 m and a height of about 1.30 m. Frustoconical section 23 may have a total volume of about 0.51 $m^3$, a height of about 0.35 m, and wall sections inclined at an angle of about 45 degrees. Finally, upper reaction chamber 22 may have a radius of about 0.50 m and a height of about 1.32 m. With a gas flow rate in solvent feed system 100 of about 30 $Nm^3$/min, waste treatment system 5 may have a resident time within vessel 20 of between about 1.75 seconds to about 2.00 seconds. Because reactions may occur within gas vent 40 which connects vessel 20 to gas conditioning and cleaning system 250, the total resident time of the waste processing system may exceed 2.00 seconds.

Figure 4:
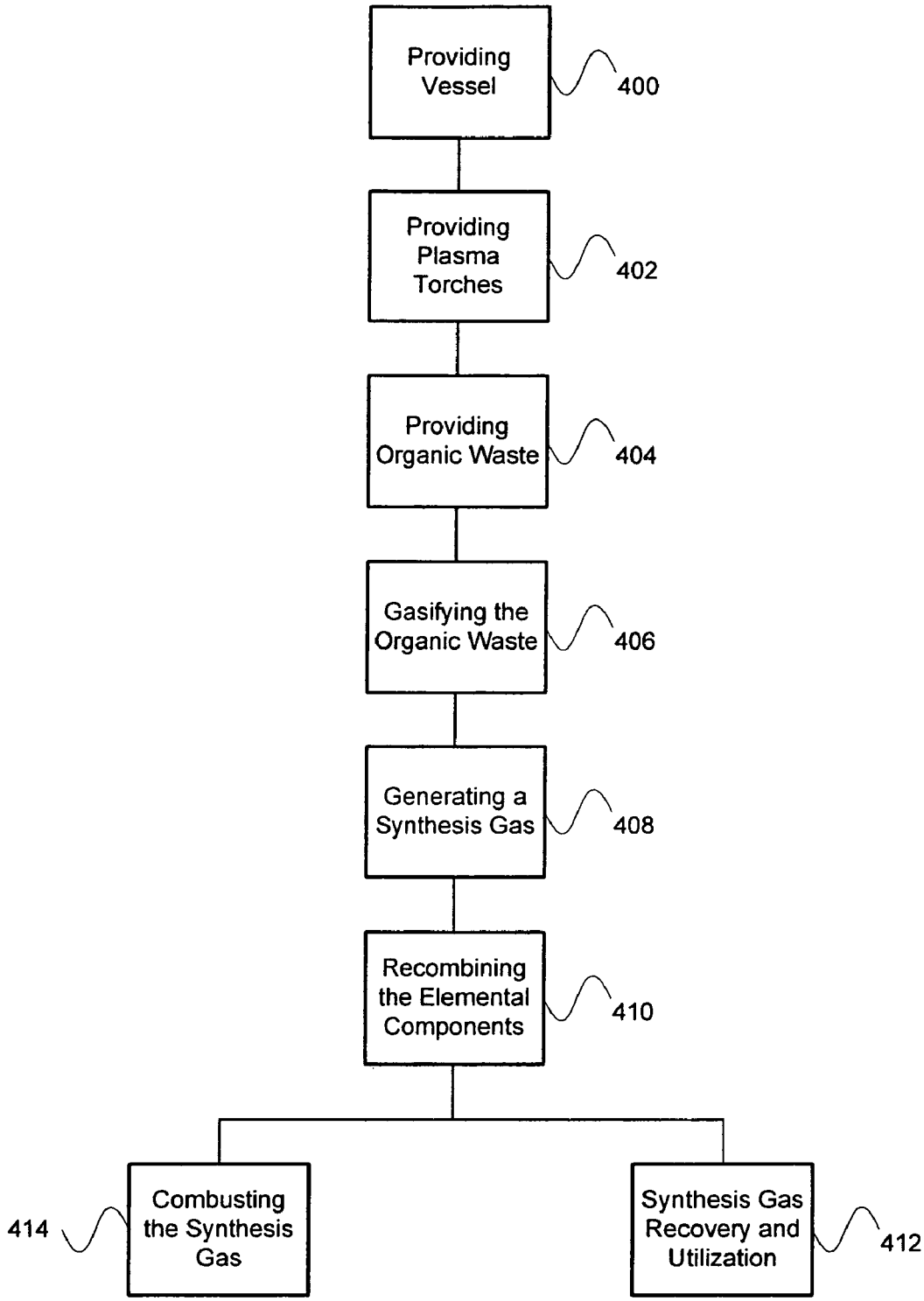
FIG. 4 is a flow diagram of a waste treatment system.

FIG. 4 is a flow diagram of a waste treatment system. At act 400, a waste treatment vessel may be provided. The waste treatment vessel may be configured such that as energy is supplied to the vessel the vessel's contents may move within the vessel in a cyclonic or substantially cyclonic pattern. Movement of the vessel's contents in a cyclonic or substantially cyclonic pattern may be facilitated by shaping at least a portion of the vessel with inclined sides, such as an upside down cone shape or a frustoconical shape. As a result of the cyclonic or substantially cyclonic pattern, the vessel's contents at a higher distance with respect to the bottom of the vessel may move about a larger radius than the contents at a lower distance with respect to the bottom of the vessel. Accordingly, the vessel's contents may move in general funnel-like shape.

At act 402, one or more plasma torches may be provided. The plasma torches may be alternating current and/or direct current plasma torches. The plasma torches may be mounted on or in the vessel, and oriented such that their plasma flames are directed towards the interior of the vessel. The plasma torches may be oriented at an incline, such as a downward angle of about 45 degrees. Additionally, the plasma torch flames' may be oriented such that the flames are not directed towards the center of the vessel. In some systems, the plasma torches may be oriented such that their flames are laterally angled at about 17 degrees with respect to the center of the vessel. Alternatively, one or more of the plasma torches may be oriented at other angles. Directing the plasma torch flames away from the center of the vessel may enhance the cyclonic or substantially cyclonic flow of the contents within the vessel.

At act 404, organic waste may be supplied to the waste treatment system. The organic waste may be provided in the form of atomized liquid waste. Atomized liquid waste may be injected into the vessel by one or more air-atomizing nozzles. Alternatively, organic waste may be extracted from solid waste that has been subjected to the energy of one or more of the plasma torches.

At act 406, the organic waste may be subjected to the energy of the one or more plasma torches until the organic waste is gasified and substantially dissociates into its elemental components. The elemental components of organic waste may include solid carbon (carbon particulate), hydrogen gas, nitrogen, and/or halogens. In some systems, the gasified organic waste may be subjected to the energy of the one or more plasma torches for a time period between about 1.75 seconds and about 2.00 seconds. The gasified organic waste may traverse a cyclonic or substantially cyclonic path while in vessel. In addition to the gasified organic waste becoming dissociated as a result of the supplied energy, some of the gasified organic waste may become dissociated as a result of its cyclonic or substantially cyclonic movement. As the gasified organic waste moves within the vessel, some of the gasified organic waste particles may collide with other gasified organic waste and/or the sides of the vessel which may result in dissociation.

At act 408, oxygen may be added to the elemental components to generate a synthesis gas. At act 410, the oxygen may combine with some of the elemental components to form carbon monoxide gas and/or carbon dioxide gas.

At act 412, the energy contained in the synthesis gas may be recovered, such as to form steam for commercial uses. The synthesis gas may be cooled to a temperature of about 600° C. to about 650° C. prior to be input to an evaporative cooler. The evaporative cooler may further cool the synthesis gas which may then be conditioned, cleaned, and made ready for commercial use. Some or substantially all of the synthesis gas may be combusted at act 414.

The following are exemplary operations using and/or configurations of waste treatment system 5 described above. Other operations and/or configurations may be realized. An exemplary operation of waste treatment system 5 may include a preheater system 22 to prepare waste treatment system 5 for operation. The preheater system may include a preheater burner which may use natural gas/liquefied petroleum gas ("LPG"), fuel oil, or stored synthesis gas as fuel to heat vessel 20 to a temperature of about 1200° C. Once the temperature in vessel 20 reaches about 1200° C., the plasma torches may be put into operation and the temperature may be increased to about 1400° C. At or around about 1400° C., waste may be added to vessel 20. Vessel 20 may be under a negative pressure of about −1 to about −1.5 inches of water column. This negative pressure may be produced by a blower positioned downstream of vessel 20 which may extract the produced synthesis gas at a substantially constant rate.

Oxidant may be injected into upper reaction chamber 22 such that lower reaction chamber 21 has a reducing atmosphere. Maintaining lower reaction chamber 21 at a reducing atmosphere may reduce metal particulates in the waste from becoming oxidized and may also reduce erosion of the Silicon-Carbide refractory materials. Pressure tapping points may be positioned in frustoconical section 23 of vessel 20 and/or in upper reaction chamber 22 of vessel 20. Isolating valves may be provided with the pressure tapping points. A water seal level may be maintained such that the pressure during operation of waste treatment system does not exceed about 4" water column. A remotely controlled and interlocked drain valve may be provided on the water seal tank which may be opened when vessel pressure exceeds a threshold for a selected time period. The drain valve may be opened when valve pressures exceeds about 4" water column for a period longer than about 10 seconds.

Waste treatment system 5 may be controlled by a local control panel and/or a control system 55 located a distance apart from waste treatment system 5. The local control panel and/or control system may be coupled to a computer system and/or server running one or more software programs operating to control waste treatment system 5. The controlling software may be configured to shut down waste treatment system 5 if a pressure threshold is exceed for a period of time (e.g., exceeding a pressure above about 4" of water column for about 10 seconds), power failure, and/or loss of cooling. In the event that one or more of the plasma torches trip, waste treatment system may transition into a standby mode such that an operator may decide a further course of action.

In case of any shutdown, vessel 20 may be secured by refilling the water seal and shutting a feed gate. The secured system may be allowed to cool down naturally. Natural cool down may avoid thermal shock to the refractory that may otherwise occur through a rapid cool down process. In the even that a restart is required, various factors may be considered to determine whether to use the preheater. One of these factors may include the temperature of vessel 20 at the time the restart procedure is required.

An exemplary waste treatment system 5 may be constructed using refractory materials identified in Tables 1-5.

TABLE 1

| Exhaust Gas Hot Pipe | | | | | | |
|---|---|---|---|---|---|---|
| Area | Layer | Refractory Material | K (kcal/mh ° C.) (at ° C.) | Thickness (mm) | Surrounding Temp (° C.) | Interface Temp (° C.) |
| Part 3 | 1 | CA-10 IW-S | 0.30 (500) | 100 | 1000 | 668 |
| | 2 | CA-8 IL-S | 0.18 (500) | 100 | | 114.7 |
| | 3 | Steel | 41.8 | 16 | | 114.6 |
| Part 2 | 1 | CA-12 IM-S | 0.32 (500) | 150 | 1200 | 705.1 |
| | 2 | CA-8 IL-S | 0.18 (500) | 100 | | 118.5 |
| | 3 | Steel | 41.8 | 16 | | 118.3 |
| Part 1 | 1 | CA-14 IW-S | 0.62 (500) | 150 | 1400 | 956.3 |
| | 2 | CA-10 IL-S | 0.23 (500) | 100 | | 159.1 |
| | 3 | Steel | 41.8 | 16 | | 158.8 |

TABLE 2

| Upper Chamber Section | | | | | | |
|---|---|---|---|---|---|---|
| Area | Layer | Refractory Material | K (kcal/mh ° C.) (at ° C.) | Thickness (mm) | Surrounding Temp (° C.) | Interface Temp (° C.) |
| Upper Furnace Section | 1 | LCA-99-S | 2.74 (1200) | 200 | 1500 | 1402.0 |
| | 2 | CA-14 IL-S | 0.40 (1200) | 100 | | 1133.4 |
| | 3 | $CaO—SiO_2$ Board | 0.106 (600) | 100 | | 120.0 |
| | 4 | Steel | 41.8 | 16 | | 119.2 |

TABLE 3

| Frustoconical Section | | | | | | |
|---|---|---|---|---|---|---|
| Area | Layer | Refractory Material | K (kcal/mh ° C.) (at ° C.) | Thickness (mm) | Surrounding Temp (° C.) | Interface Temp (° C.) |
| Frustoconical Section | 1 | LCA-99-S | 2.74 (1200) | 250 | 1500 | 1402.0 |
| | 2 | CA-14 IL-S | 0.40 (1200) | 100 | | 1133.4 |
| | 3 | $CaO—SiO_2$ Board | 0.106 (600) | 100 | | 120.0 |
| | 4 | Steel | 41.8 | 16 | | 119.2 |

TABLE 4

| Upper Section of Lower Chamber | | | | | | |
|---|---|---|---|---|---|---|
| Area | Layer | Refractory Material | K (kcal/mh ° C.) (at ° C.) | Thickness (mm) | Surrounding Temp (° C.) | Interface Temp (° C.) |
| Upper Section of Lower Chamber | 1 | LCA-99-S | 2.74 (1200) | 250 | 1700 | 1583.50 |
| | 2 | Insulating Brick IN26 | 0.35 (1200) | 114 | | 1167.6 |
| | 3 | $CaO—SiO_2$ Board | 0.106 (600) | 86 | | 131.6 |
| | 4 | Steel | 41.8 | 16 | | 130.7 |

TABLE 5

| Slag/Metal Bath | | | | | | |
|---|---|---|---|---|---|---|
| Area | Layer | Refractory Material | K (kcal/mh ° C.) (at ° C.) | Thickness (mm) | Surrounding Temp (° C.) | Interface Temp (° C.) |
| Upper Section of Lower Chamber | 1 | SialonBondSiC Brick | 13.76 (1200) | 222 | 1500 | 1479.9 |
| | 2 | Insulating Brick IN26 | 0.35 (1200) | 114 | | 1074.9 |
| | 3 | Insulating Brink IN20 | 0.15 (600) | 114 | | 129.8 |
| | 4 | Steel | 41.8 | 16 | | 128.9 |

Exemplary specifications of a DC torch, manufactured by Advanced Plasma Technology, Inc., of Korea, which may be used with waste treatment system 5 are shown in Table 6.

TABLE 6

| DC Torch | |
|---|---|
| Type | Non transferred hollow cathode |
| Polarity | Reverse biased |
| Maximum power | 350 kW |

TABLE 6-continued

| DC Torch | |
|---|---|
| Operating range | 150-350 kW |
| Nominal operation DC voltage | 450-600 V |
| Operational current range | 200-600 A DC |
| Nominal power fluctuation | <5% SD |
| Nominal arc power efficiency | >70% |
| Power supply type | SCR phase control |

TABLE 6-continued

| DC Torch | |
|---|---|
| Cooling | Chilled water <30° C. |
| Torch gas | Air |

The torch air consumption may be about 1 to about 1.5 $Nm^3$/min at about 5 to about 7 $kg/cm^2$. Air should preferably by dry with a dew point of about 2° C. at about 7 $kg/cm^2$ and about −23° C. at atmospheric pressure. Cooling water may have electrical resistivity greater than about 3000 W cm. At a pressure of about 6 to about 10 $kg/cm^2$, the cooling water flow should be 250 liters per minute. Plumes of the DC torch may extend about 700 mm from the tip of the torch. In a vessel 20 with a refractory thickness of about 450 mm, the plasma plumes may begin at a distance of about 228 mm from the inside face of the vessel and may extend about an additional 700 mm. With such a configuration, the ends of the torch plumes may reach about 928 mm into the vessel.

Waste treatment system 5 may be designed to process waste having compositions as identified in Tables 7-10.

TABLE 7

| Organic Solid Wastes (representative composition): | |
|---|---|
| Component | Percentage by Weight |
| C | 29.53 |
| $H_2$ | 2.91 |
| $Cl_2$ | 5.08 |
| $O_2$ | 6.09 |
| $N_2$ | 4.63 |
| S | 1.41 |
| $H_2O$ | 17.32 |
| Ash/$SiO_2$ | 33.03 |
| Total | 100.00 |

TABLE 8

| Waste Solvents and Polychlorinated Biphenyls: | |
|---|---|
| Constituent | Percentage by Weight |
| Benzene $C_6H_6$ | 37.78 |
| PCB Aroclor 1254 $C_{12}H_5Cl_5$ | 16.33 |
| PCB Aroclor 1242 $C_{12}H_5Cl_5$ | 16.33 |
| N-Dodecane $C_{12}H_{26}$ | 10.33 |
| N-Hexadecane $C_{16}H_{34}$ | 10.33 |
| $SiO_2$ | 1.11 |
| $H_2O$ | 7.78 |
| Total | 100.00 |

TABLE 9

| Waste Batteries | |
|---|---|
| Component | Percentage by Weight |
| C | 17.29 |
| H | 1.69 |
| Cl | 0.17 |
| O | 8.36 |
| N | 0.26 |
| S | 0.06 |
| $SiO_2$ | 4.14 |
| KOH | 8.49 |

TABLE 9-continued

| Waste Batteries | |
|---|---|
| Component | Percentage by Weight |
| Cd | 0.006 |
| Hg | 1.06 |
| Zn | 11.52 |
| $MnO_2$ | 23.86 |
| Fe | 20.45 |
| $H_2O$ | 2.65 |

TABLE 10

| Heavy Metal Sludge: | |
|---|---|
| Component | Percentage by Weight |
| S | 6.35 |
| $H_2O$ | 10.00 |
| $CrO_3$ | 22.88 |
| $Na_2CrO_4$ | 9.85 |
| $PbCrO_4$ | 13.05 |
| $Na_2Cr_2O_7$ | 22.88 |
| $As_2O_3$ | 15.00 |

An exemplary composition of waste that may be processed by a 20 metric ton per day facility is identified in Table 11.

TABLE 11

| Composition of Processed Waste Per Day | |
|---|---|
| Type of waste | Amount of waste in Tons |
| Organic solid waste | 3 |
| Heavy metal sludge | 5 |
| Organic solvents and PCBs | 9 |
| Waste batteries | 3 |
| Total | 20 |

Table 12 identifies an exemplary synthesis gas composition and flow rates for waste treatment system 5 based on a design according to Tables 7-11.

TABLE 12

| Synthesis Gas Composition and Flow Rates | | |
|---|---|---|
| Component | kg/hr | Mol Percentage |
| $H_2$ | 48.22 | 29.76 |
| $N_2$ | 265.04 | 11.77 |
| CO | 982.85 | 43.67 |
| $CO_2$ | 210.61 | 5.96 |
| $SO_2$ | 0.48 | 0.01 |
| $H_2S$ | 25.23 | 0.92 |
| HCl | 105.35 | 3.60 |
| Approximate total of expected particulates and metal oxides | 141.88 | 4.31 |
| Total kg/hr | 1779.66 | |
| Total $Nm^3$/hr | 1800 | |

Table 13 identifies exemplary constituents of particulate matter entrainted in the gas stream based on a design according to Tables 7-11.

TABLE 13

| Component | kg/hr |
|---|---|
| K (gas) | 5.89 |
| Na (gas) | 11.31 |
| Zn (gas) | 17.20 |
| Hg (gas) | 2.12 |
| Cd (gas) | 0.013 |
| Pb (gas) | 20.82 |
| $SiO_2$ (particulate) | 2.42 |
| $Fe_2O_3$ (particulate) | 1.74 |
| Fe (particulate) | 0.41 |
| $Cr_2O_3$ (particulate) | 3.82 |
| MnO (particulate) | 1.16 |
| C (particulate) | 25.20 |
| $As_2O_3$ (gas) | 49.78 |

An exemplary solid waste feed system 10 may have a maximum waste feed rate of about 850 kg/hr, and may be designed to operate at a feed rate of about 650 kg/hr. A bulk density range of materials for solid waste feed system 100 may be between about 115 kg/m$^3$ to about 1600 kg/m$^3$, with an average bulk density of materials of about 450 kg/m$^3$. Additionally, the moisture content of materials fed to solid waste feed system may be between about 5% to about 35%, with an average moisture content of 20%. Waste may be delivered to solid waste feed system in Super Sacks, 55-gallon drums, wheeled carts, and/or other known containers. Delivered solid waste containers may be lifted and deposited, or tilted, such that the waste is deposited within the charging hopper, through known introduction systems. Charging hopper and feed hopper may have a minimum capacity of 1.5 m$^3$. Additionally, an exemplary solid waste feed system 10 may be designed to accommodate a feed rate of about 250 kg/hr of dried sludge.

While it is understood that other materials may be used, the charging hopper and feed hopper of an exemplary solid waste feed system may be constructed out of carbon steel. Moreover, the isolation gates may be constructed out of carbon steel and may include a knife-like edge that may cut through any waste material that may be within an isolation gate's path as it transitions from an open state to a closed state. An exemplary solid waste feed system may also include a variable speed 40 HP Hydrostatic drive with encoder feedback for speed control, 2 door infeed slide gates with infeed chamber, 316 stainless steel ("SS") isolation gate with failsafe accumulator circuit, 326 SS initial split flange extrusion tube section, Allen Bradley PLC control system, and feed support stand to position the feeder at an about 15 degree angle with respect to a pyrolysis vessel.

An exemplary solvent waste feed system 100 may be designed with a feed rate per nozzle of about 235 kg/hr to about 250 kg/hr. Based on the exemplary waste treatment system, an exemplary gas cleaning and conditioning system may use about 15 liters per minute per ton per hour of processed waste to cool the synthesis gas from about 1200 degrees Celsius to about 180 degrees Celsius. In an exemplary waste treatment system that include a heat recovery steam generator ("HSRG"), the HSRG may remove about 340 kw-hr/ton of feedstock processed to generate about 280 kg/ton of feedstock processed of process steam (at about 30 bar, saturated), assuming a typical HSRG thermal efficiency of about 41%. If the HRSG is installed upstream of the gas cleaning system, the load on the evaporative cooler may be reduced by approximately 7 liters/minute.

Examples of waste that may be processed using waste system 5 may be medical waste (Table 14); Heavy metal sludges; ashes, laboratory wastes including waste acids; waste caustics, and/or chlorinated solvents and/or solutions; and or waste consumer batteries (Table 15-19).

TABLE 14

| Medical Waste | | | | | |
|---|---|---|---|---|---|
| Component | Hospital A | Hospital B | Hospital C | Hospital D | Average |
| Density (kg/m$^3$) | 82 | 121 | 154 | 108 | 116 |
| Paper | 50.99% | 34.22% | 37.30% | 27.37% | 37.47% |
| Cotton | 1.53% | 14.18% | 14.70% | 4.23% | 8.66% |
| Wood & Fiber | 2.65% | 1.03% | 2.80% | 6.27% | 3.19% |
| Kitchen Residual | 6.36% | 16.61% | 0.00% | 17.50% | 10.12% |
| Plastics | 17.97% | 20.78% | 13.40% | 25.50% | 19.41% |
| Leathers/ Rubber | 2.32% | 0.00% | 24.90% | 0.00% | 6.81% |
| Others | 1.20% | 0.94% | 4.60% | 7.39% | 3.53% |
| Metal | 9.09% | 1.36% | 0.90% | 6.67% | 4.51% |
| Glass | 7.97% | 10.88% | 1.40% | 5.0% | 6.33% |
| Ceramic | * | * | * | * | * |
| Sand | * | * | * | * | * |
| Total | | | | | 100% |

TABLE 15

| Types of batteries that may be processed |
|---|
| Alkaline, Zinc Manganese, Zinc Carbon AAA, D, A, and 1.5 volts, 6 volts, 9 volts, and/or 12 volts. |
| Alkaline, Zinc Manganese, Zinc Carbon Packed |
| Alkaline, Button types |
| Lithium (including all cell phone batteries) |
| Mercury |
| Nickel Cadmium |
| Nickel Metal Hydride |
| Buttoncell Batteries including Alkaline, Zinc Manganese, Lithium, Mercury, and/or Silver |

TABLE 16

| Possible Composition of Post Consumer Alkaline Batteries | |
|---|---|
| Component | Weight Percentage |
| Palted Steel Nylon Metals (L-Steel) Collector (Brass, Cu, Zinc (99.9% Pure)) | 11.5615 |
| $MnO_2$ | 23.864 |
| Graphite, Acetylene Blk | 4.545 |
| Fabric | 0.000 |
| KOH—$K_2O$ | 8.485 |
| Moisture | 2.652 |
| Hg | 1.061 |
| Cadmium | 0.006 |
| Gel | 0.909 |
| Binders inhibitors/fabric | 26.545 |
| Metals (plated steel, Brass, Cu) | 20.448 |
| Total | 100.00 |

TABLE 17

| Possible Composition of Post Consumer Nickel Cadmium Batteries | |
|---|---|
| Component | Weight Percentage |
| Nickel Oxy Hydroxide-Cathode | 233.256 |
| $O_2$ PLU OH | 1.550 |

TABLE 17-continued

| Possible Composition of Post Consumer Nickel Cadmium Batteries | |
|---|---|
| Component | Weight Percentage |
| OH | 1.705 |
| Cadmium-Anode | 31.783 |
| KOH goes to $K_2O$ (Electrolyte) | 6.977 |
| $H_2O$ | 0.000 |
| Carbon Steel (Fe) | 20.620 |
| Plastic - Paper, Fabric | 14.109 |
| Total | 100.00 |

TABLE 18

| Possible Types of Lithium Batteries |
|---|
| Lithium-Manganese Dioxide |
| Lithium-Sulfur Dioxide |
| Lithium-Thionyl Chloride |

TABLE 19

| Possible Components of Lithium-Thionyl Chloride Batteries | |
|---|---|
| Component | Weight Percentage |
| Lithium | 1.7 |
| Lithium Chloride | 20.1 |
| Sulfur Dioxide | 7.6 |
| Lithium Tetrachloroaluminate | 7.5 |
| Thionyl Chloride | 9.1 |
| Carbon, separators, inert | 10.5 |
| Steel Case | 38.0 |
| Copper | 0.5 |
| Nickel | 1.2 |
| Sulfur | 3.8 |
| Total | 100.0 |

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A method of treating waste, comprising:

connecting a plurality of plasma torches to a vessel that facilitates a cyclonic flow of a synthesis gas within the vessel;

introducing organic waste into the vessel through a solid waste feed opening;

introducing solvent waste into the vessel through a plurality of nozzles;

gasifying the organic waste and the solvent waste through the use of the plurality plasma torches;

dissociating molecules of the gasified organic waste and the solvent waste;

reforming the dissociated molecules of the gasified organic waste and the solvent waste into the synthesis gas comprising elemental components and hydrogen gas;

where the plurality of plasma torches are oriented to enhance the cyclonic flow of the synthesis gas within a generally cylindrical upper section of the vessel, and where one of the plurality of plasma torches is positioned with a plasma plume toward the solid waste feed opening, and a second of the plurality of plasma torches is positioned with its plasma plume at a downward angle toward one of the plurality of nozzles of the solvent feed system.

2. The method of claim 1, where the act of dissociating molecules of the gasified organic waste comprises subjecting the gasified organic waste to a plasma energy field for a time period between about 1.75 seconds and about 2.00 seconds.

3. The method of claim 1, where the act of dissociating molecules of the gasified organic waste further comprises subjecting the gasified organic waste to the plasma energy field in a low oxygen environment.

4. The method of claim 3, further comprising injecting solvent waste through the plurality of nozzles at substantially the same time.

5. The method of claim 3, further comprising injecting solvent waste through the plurality of nozzles in an alternating manner.

6. The method of claim 3, further comprising detecting chemical species output from the vessel.

7. The method of claim 6, further comprising altering a feed rate at which the organic waste is provide to the vessel in response to the detected chemical species.

8. The method of claim 6, further comprising altering a composition of a feed stock of the organic waste provided to the vessel in response to the detected chemical species.

9. A waste treatment system, comprising:

a vessel comprising a generally cylindrical lower section, a generally frustoconical section coupled to the generally cylindrical lower section, and a generally cylindrical upper section, the vessel having an open space that facilitates a substantially cyclonic flow of a synthesis gas within the vessel into the generally cylindrical upper section of the vessel;

a solid waste feed system configured to introduce solid waste, through a solid waste feed opening, into the open space of the vessel, the solid waste feed system coupled to the vessel;

a solvent waste feed system configured to introduce liquid waste into the open space of the vessel through a plurality of nozzles, the solvent waste feed system coupled to the vessel;

a plurality of plasma torches mounted to the vessel and directed into the open space thereof, the plurality of plasma torches positioned to enhance the substantially cyclonic flow of the synthesis gas in the generally cylindrical upper section of the vessel, where the generally cylindrical lower section is maintained at a lower oxygen level as compared to the generally cylindrical upper section, and where one of the plurality of plasma torches is positioned with a plasma plume toward the solid waste feed opening, and a second of the plurality of plasma torches is positioned with its plasma plume at a downward angle toward one of the plurality of nozzles of the solvent feed system.

10. The system of claim 9, where the generally cylindrical lower section comprises a substantially larger outer diameter than a bottom portion of the generally cylindrical upper section.

11. The system of claim 10, where the generally frustoconical section comprises a wall section angled at an angle of about 45 degrees.

12. The system of claim 11, further comprising a detector that identifies chemical species output from the vessel in terms of their different isotopic masses.

13. The system of claim 12, where the detector is configured to detect species selected from the group consisting of CO, $CO_2$, $H_2$, $CH_4$, $N_2$, $O_2$, and $H_2S$.

14. The system of claim 13, where one of the plurality of plasma torches is oriented at an angle of about 45 degrees with respect to a vertical axis.

15. The system of claim 14, where one of the plasma torches is positioned at an angle of about 17 degrees with respect to an imaginary center line extended from the one plasma torch and passing through a center point of the vessel.

16. The system of claim 9, where the plurality of plasma torches comprise alternating current torches.

17. The system of claim 9, where the plurality of plasma torches comprise direct current torches.

* * * * *